US005465912A

United States Patent [19]

Graybill et al.

[11] Patent Number: 5,465,912

[45] Date of Patent: Nov. 14, 1995

[54] PULVERIZING AND GRINDING HAMMER

[75] Inventors: James B. Graybill, Berkeley Heights; Larry M. Hixon, Pittstown; Ching-Chung Huang, Summit, all of N.J.

[73] Assignee: Hosokawa Micron International Inc., New York, N.Y.

[21] Appl. No.: 212,590

[22] Filed: Mar. 11, 1994

[51] Int. Cl.[6] ..... B02C 13/04; B02C 13/28

[52] U.S. Cl. ..... 241/27; 241/194; 241/197; 241/291

[58] Field of Search ..... 241/194, 197, 241/291, 300, 27

[56] References Cited

U.S. PATENT DOCUMENTS

| | | | |
|---|---|---|---|
| 1,622,849 | 3/1927 | Ruprecht et al. . | |
| 2,208,892 | 7/1940 | Bukacek | 83/11 |
| 2,316,124 | 4/1943 | Sheldon | 83/11 |
| 2,488,799 | 11/1949 | Bonnafoux | 241/60 |
| 2,558,107 | 6/1951 | Smith . | |
| 2,827,242 | 3/1958 | Sheldon | 241/186 |
| 3,322,356 | 5/1967 | Toews | 241/197 |
| 3,367,585 | 2/1968 | Ratkowski . | |
| 3,561,686 | 2/1971 | Hedrick | 241/197 |
| 3,612,240 | 10/1971 | Hull | 241/191 |
| 3,844,494 | 10/1974 | Hightower . | |

FOREIGN PATENT DOCUMENTS

| | | | |
|---|---|---|---|
| 301386 | 10/1932 | Italy | 241/197 |
| 0618129 | 8/1978 | U.S.S.R. | 241/197 |
| 0680758 | 9/1979 | U.S.S.R. | 241/197 |

*Primary Examiner*—John Husar

*Attorney, Agent, or Firm*—Fitzpatrick, Cella, Harper & Scinto

[57] ABSTRACT

An improved pulverizing and grinding hammer and methods of making and using such a hammer in a hammer mill are disclosed. The improved hammer has a substantially trapezoidal insert made of a hard metal such as STELLITE 12 that is brazed onto a groove in a conventional hammer to form a contact face having an approximately ten degree layback angle with the vertical. The improved hammer provides a clear visible boundary between the insert material and base metal of the hammer, which acts as a wear indicator when the layback angle wears to approximately 40 to 50 degrees, the critical angle at which the size reduction efficiency of the mill decreases.

16 Claims, 2 Drawing Sheets

PULVERIZING AND GRINDING HAMMER

BACKGROUND OF TEE INVENTION

1. Field of the Invention

The present invention relates to improved pulverizing and grinding hammers used in hammer mills to mechanically impact material fed into the mill, thereby reducing the size of the material particles. The improved hammer has a substantially trapezoidal insert made of a hard metal such as STELLITE 12 that is brazed onto a hammer head. The insert forms a contact face having an approximately ten degree layback angle with the vertical. The improved hammer has a longer useful life and can be used more efficiently than conventional hammers. The improved hammer also provides a clear boundary between the insert material and base metal of the hammer, which acts as a wear indicator to indicate when the layback angle wears to approximately 40 to 50 degrees, the critical angle at which mill pulverizing and grinding efficiency decreases.

2. Description of the Related Art

Hammer mills pulverize and grind materials as diverse as coal, minerals, sugar, pharmaceuticals, and food. A hammer mill contains a number of hammers that are each attached to a rotor at one of the pivot points spaced along the circumference of the rotor. When the rotor rotates, the hammers extend radially from the rotor due to centrifugal force, striking and pulverizing material fed into the mill. When the rotor is rotating and the hammers are radially extended from the rotor, there is little clearance between the top of the hammers and the liner on the upper mill chamber. Larger particles fed into the mill are impacted by the hammers and may also enter that clearance space and become ground between the top of the hammer and the mill liner. The particles exit the mill when they are ground to a size that will pass through a screen in the bottom of the mill. General descriptions of hammer mills are provided in U.S. Pat. No. 2,488,799 to Bonnafoux, and U.S. Pat. No. 2,316,124 to Sheldon.

The hammers in a hammer mill may be U-shaped or stirrup-type structures formed by a head and two legs extending down from the head. A hard face is formed on the front of the head where the head contacts the material to be pulverized and ground. The hard face of the head may be formed from a cobalt based alloy such as STELLITE 12 or STELLITE 6, or may be formed from an iron based alloy. STELLITE 12 and STELLITE 6 are registered trademarks of the Stoody Deloro Stellite Company. The rest of the head and the legs of the hammer are usually made of other materials such as carbon steel and stainless steel to reduce material costs and allow easy formation and better impact resistance. A general description of stirrup-type hammers is provided in U.S. Pat. No. 2,827,242 to Sheldon.

Two known methods of preparing the hard face of a hammer are to apply molten material to the head by conventional welding or plasma transfer arc welding, and then grinding the welded face material to a flat surface that forms an angle with the vertical. This angle between the vertical and the face is known as the layback angle. Test results show that a layback angle prevents a problem known as windage, in which less feed material is ground and the mill operates at a higher, less efficient temperature due to air turbulence. A hammer mill operates more efficiently, i.e. at a higher capacity and a lower temperature, when the layback angle is about 7.5°–15° rather than 0°.

In ordinary use, the hard face of the hammer wears more quickly near its top such that the layback angle increases with use. This wear pattern occurs because most of the material to be ground is concentrated in a shallow layer around the inside of the chamber, and because some of the larger particles of the fed material are ground by the top of the hammer against the liner on the upper mill chamber. It is therefore desirable to have a hammer with more face material near the top of the head for longer hammer life. In order to place more face material near the top, hammer manufacturers typically weld additional material at the top which results in an inverted triangular cross sectional area for the hard face material of conventional hammers.

Without increasing the size of the head it is not possible to weld excessive amounts of face material to the head, since to do so results in the weld material overflowing around the head and burning through the back of the head opposite the face. Conventionally sized hammers with welded faces are therefore limited in the amount of layback angle that can obtained with wear, and have a correspondingly limited useful life. Increasing the size of the head to allow for the application of more weld material is not desirable since that would increase the weight of the hammer and require more power to run the mill. Even if the size of the head is increased, the problem of material overflowing around the head remains.

When the hammer face wears off from use, the softer base metal of the head becomes exposed. If the mill is operated with the base metal of the hammer exposed, pulverizing and grinding efficiency decreases dramatically. By operating in this manner, the hammer mill is also more likely to break down due to vibration, resulting in expensive repairs and downtime. Users therefore need to remove and replace hammers before the base metal of the head is exposed. Users also want to incur minimal maintenance costs and interference with operation, and therefore want to use a hammer for its full life, removing it only when substantially all of the face material is worn away from the head.

To ensure that the base metal is not exposed during mill operation, resulting in decreased pulverizing and grinding efficiency and possible mill breakdown, users must determine when to remove and replace a hammer by visually estimating when the face material has worn away. It is difficult to visually estimate when a welded face has worn away, since welding results in significant penetration of the weld material into the base metal of the head such that there is no uniform visible boundary between the face and the base metal. This is true with both conventional and plasma transfer arc welding. Users therefore cannot accurately determine when the hammer is nearing the end of its useful life. Welding is also subject to operator control and error, which often results in porosity and shrinkage in the welded area and corresponding weakness in the hammer.

Accordingly, there is a need to provide an efficient, long-lived, hard-faced hammer for a hammer mill with a wear indicator which can accurately indicate when the hammer is nearing the end of its useful life.

It is therefore an object of this invention to provide an improved, efficient, long-lived, hard-faced hammer for a hammer mill.

It is also an object of this invention to provide an improved hammer for use in a hammer mill which is of conventional size.

A further object of the invention is to provide a hammer for use in a hammer mill with a wear indicator which can accurately indicate when the hammer is nearing the end of its useful life.

Another object of this invention is to provide a method of making an efficient, long-lived, hard-faced hammer for a hammer mill.

SUMMARY OF THE INVENTION

These and other objects of the present invention are met by providing an improved pulverizing and grinding hammer for use in hammer mills. The improved hammer of our invention has a hard substantially trapezoidal insert that is brazed onto a conventional hammer head to form a contact face having an approximately ten or less degree layback angle with the vertical. In the preferred embodiment of the improved hammer, the insert is made of extruded and sintered STELLITE 12, a cobalt based alloy, and has sufficient material to allow the layback angle to wear to 40 to 50 degrees, the critical angle at which mill grinding efficiency begins to decrease. Prior art hammers did not have sufficient material to allow wear to the critical angle. The improved hammer is efficient and has a long life and a built-in wear indicator at the boundary of the insert and base metal of the top of the head; which provide a more efficient use of the hammer mill.

The present invention is further described in reference to the attached drawings.

DESCRIPTION OF THE PREFERRED EMBODIMENT

Figure 1:
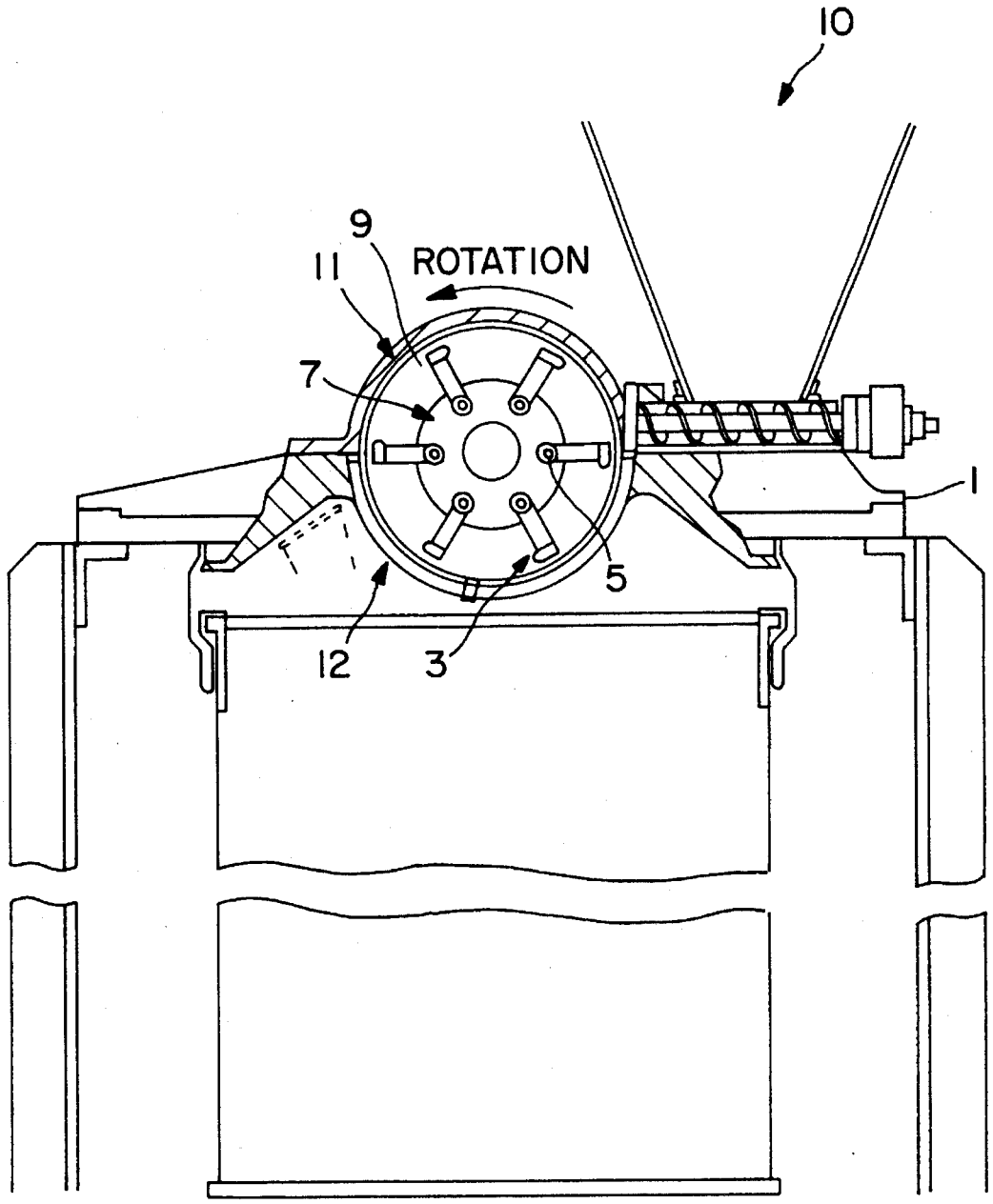
FIG. 1 is a cross-sectional view of a hammer mill of the type in which hammers of the present invention may be used.

As shown in FIG. 1, in a hammer mill 1 a number of hammers 3 are anchored at pivot points 5 along the circumference of one of a number of rotors 7. When the rotors 7 rotate, the hammers 3 extend radially from the rotors 7 inside the mill chamber 9, pulverizing the material which is fed from the hopper 10 into the mill and grinding the fed material against the wall 11. The ground particles exit the mill 1 when they are pulverized and ground to a size that will allow them to pass through a screen 12 in the bottom of the mill.

Figure 3:
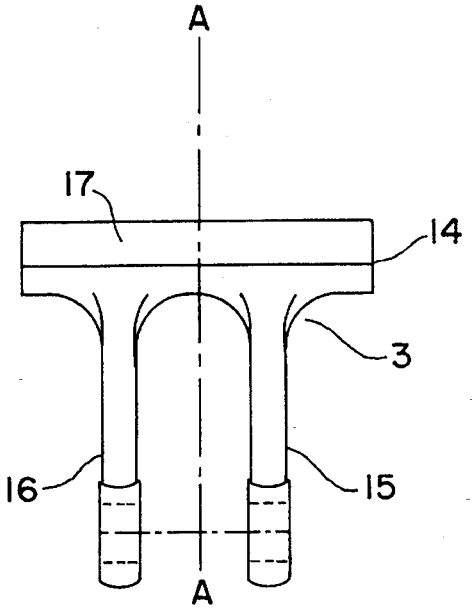
FIG. 3 is a front view of a pulverizing and grinding hammer of the present invention for use in a conventional hammer mill.

As shown in FIG. 3, the hammers 3 for a hammer mill are generally U-shaped or stirrup-type structures formed by a head 14 and two legs 15, 16 extending down from the head. A hard face 17 is formed on the front and top of the head 14 where the head contacts the material to be pulverized and ground. The hard face 17 of the head 14 may be formed from a cobalt based alloy such as STELLITE 12 or STELLITE 6, or from an iron based alloy. The rest of the head 14 and the legs 15, 16 of the hammer 3 are usually made of conventional steel or stainless steel to reduce material costs and allow easy formation and better impact resistance.

Figure 2:
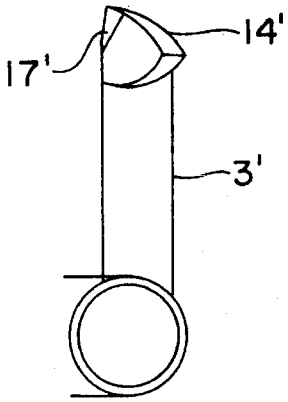
FIG. 2 PRIOR ART
FIG. 2 is a side cross-sectional view of a conventional hammer for a hammer mill.

FIG. 2 shows the cross-section of hard face 17 of a conventional hammer 3', in which the hard face 17' is formed by depositing weld material on the hammer head 14'. The hard face 17' has an inverted triangular cross-section due to the need for more material at the top of the hammer 3', where most of the pulverizing and grinding takes place. With a conventional hammer 3', it is not possible to weld excessive amounts of face material to the head 14', because attempts to apply more material result in the weld material overflowing around the head 14' and burning through the back of the head 14' opposite the face 17'.

Tests show that as the hard face wears with use beyond a critical point, the degree of particle size reduction achieved by pulverizing and grinding the material decreases sharply. In other words, the effectiveness of the hammer becomes a function of the increased layback angle. The hard face of conventional hammers wears out before reaching that critical point, and the hammer must be removed and replaced before that point is reached. However, hammers of the present invention installed in hammer mills are still effective when the layback angle wears to the critical point of about 40 to 50 degrees, since additional hard face material is present in the improved hammers.

For example, 120 mesh silica sand was fed into a hammer mill operating at 10,050 RPM with a 0.125 inch round stainless steel screen. After six minutes of operation, the ground material was removed and its size measured. This was repeated for twelve trials, and the layback angle of the hammer was also measured after some of the trials. The results showed there is a sharp increase in the size of the particles ground per unit of time as the layback angle approaches 50 degrees. In other words, there is a sharp reduction in the size reduction efficiency of the hammers after the layback angle wears to approximately 50 degrees. The results show that with a hammer layback angle of 30°, the particles were ground to a mean size of 54.98 microns; with a layback angle of 50°, the mean particle size was 64.52 microns; with a 70° angle, the mean particle size was 80.96 microns; and with a 75°–77° angle, the mean particle size was 79.04 to 89.82 microns.

Based on this data, the size reduction efficiency of the hammers is believed to decrease substantially at about a 40 to 50 degree layback angle.

Figure 4:
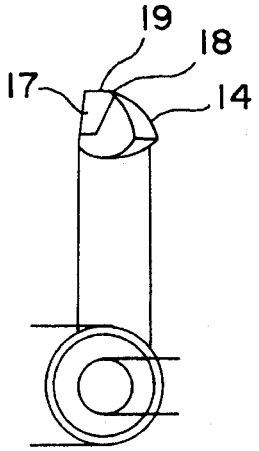
FIG. 4 is a side cross-sectional view of the hammer of FIG. 3 taken along line A—A.

In the present invention as shown in FIGS. 3 and 4, hammer 3 has a head 14 and two legs 15, 16 extending down from the head. The free ends of the legs 15, 16 are pivotally attachable to the rotor of a hammer mill. A metallic insert 19 is attached to the head 14 and forms the hard face 17 for pulverizing and grinding the material fed into the hammer mill. The metallic insert 19 is made from a cobalt based alloy such as STELLITE 12 or STELLITE 6, or from an iron based alloy. The metallic insert 19 may be formed by either extrusion and sintering or by investment casting.

Figure 5:
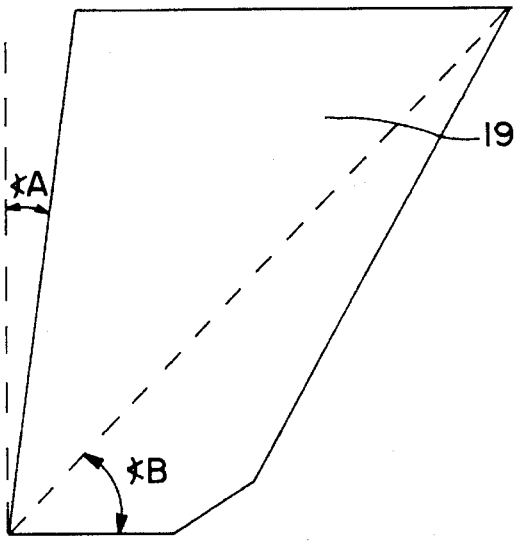
FIG. 5 is a side cross-sectional view of the insert of the hammer of FIG. 4.

As shown in FIGS. 4 and 5, the metallic insert 19 has a substantially trapezoidal cross-section in which the top edge and bottom edge are approximately parallel, the front edge and bottom edge form an acute angle of approximately 80 degrees or more, and the rear edge and bottom edge form an angle of approximately 115 to 125 degrees. The head 14 has a groove located at the top front for holding the metallic insert 19, which attaches to the groove at the surfaces in which the bottom edge and rear edge lie.

In a preferred embodiment of the present invention, the angle formed by the front edge and bottom edge of the insert 19 is 82.5 degrees, which provides a starting layback angle A of 7.5 degrees. The angle B formed by the bottom edge of the insert 19 and a line drawn from the intersection of the bottom and front edges to the intersection of the top and rear edges is between 40 to 50 degrees. The present invention therefore provides a hammer having a hard face material even when the layback angle wears to the critical angle above which size reduction efficiency decreases. In the preferred embodiment of the present invention, the substantially trapezoid of the metallic insert 19 is formed such that the angle B is 45 degrees.

The metallic insert 19 is attached to the head 14 at a groove by a brazing operation. Appropriate brazing techniques include oven brazing or induction brazing using a suitable brazing alloy such as a silver or copper based brazing alloy.

As a result of the present invention, the rear edge of the metallic insert 19 and the exposed top of the head 14 form a sharp, visible boundary 18 which acts as a wear indicator. Due to the geometric design of the insert 19 and the braze attachment of the insert 19 to the head 14, visual inspection of the hammer 3 reveals when wear has caused the layback angle B to wear to the critical angle A of approximately 40 to 50 degrees. This allows hammer users to accurately determine when the base metal of the hammer head 14 is nearly exposed and consequently when the hammer is nearing the end of its useful life.

Hammers 3 of the present invention are useful as pulverizing and grinding hammers by installing them at pivot points 5 along the circumference of a rotor 7, feeding material to be ground into the hammer mill 1, and rotating the rotor 7. Operation is complete when the material is pulverized and ground to a size sufficient to pass through screen 12.

While both the apparatus and method of this invention have been described in connection with several specific embodiments, it should be understood that numerous modifications in dimensions, materials and/or techniques could be made by persons of ordinary skill in this art without departing from the scope of this invention. Accordingly, the foregoing description is intended to be merely illustrative and is not limiting. The scope of the invention as claimed should be understood to include all those alternatives and modifications which the above specification and drawings would suggest or which would readily occur or be apparent to one skilled in the art upon study of the same.

What we claim is:

1. A hammer for use in a hammer mill, comprising:

a head for impacting material within the hammer mill;

two parallel legs extending from the bottom of said head for being attached to a rotor of the hammer mill; and a metallic insert attached to a portion of an impact surface of said head, said metallic insert having a substantially trapezoidal cross section in which the top and bottom edges are approximately parallel, the front edge and bottom edge form an acute angle of approximately 75 degrees or more, and the rear edge and bottom edge form an angle greater than 105 degrees, so that the top surface initially has more surface area than the bottom surface.

2. A hammer according to claim 1, wherein the head has a top, a bottom, a front, and a back, with a groove for holding said metallic insert located at the top of the front.

3. A hammer according to claim 2, wherein the rear edge of said metallic insert and the top of said head form a visible boundary that serves as a wear indicator.

4. A hammer according to claim 2, wherein the surfaces in which the bottom edge and the rear edge of said insert lie are attached to said head at the groove.

5. A hammer according to claim 4, wherein the angle formed by the front edge and bottom edge of the insert is 82.5 degrees.

6. A hammer according to claim 2, wherein said metallic insert is attached to the head at the groove by brazing.

7. A hammer according to claim 1, wherein said metallic insert is made from a cobalt based alloy.

8. A hammer according to claim 1, wherein said metallic insert is made from an iron based alloy.

9. A hammer according to claim 1, wherein an angle formed by the bottom edge of the insert and a line drawn from the intersection of the bottom and front edges to the intersection of the top and rear edges is between 40 to 50 degrees.

10. A hammer according to claim 1, wherein the angle formed by the front edge and bottom edge of the insert is 82.5 degrees, the angle formed by rear edge and bottom edge of the insert is 119 degrees, and said metallic insert is made from a cobalt based alloy.

11. A hammer for use in a hammer mill, comprising:

a head for impacting material within the hammer mill, said head having a top, a bottom, a front, and a back, with a groove located at the top of the front;

two parallel legs, extending from the bottom of said head, for being attached to a rotor of the hammer mill; and a metallic insert made of a cobalt based alloy and attached to the groove of said head, said metallic insert having a substantially trapezoidal cross section in which the top and bottom edges are approximately parallel, the front edge and bottom edge form an acute angle of approximately 75 degrees or more, and the rear edge and bottom edge form an angle greater than 105 degrees, so that the top surface initially has more surface area than the bottom surface, wherein (i) the surfaces in which the bottom edge and the rear edge of said insert lie are attached to the groove of said head by brazing and (ii) the rear edge of said metallic insert and the top of said head form a wear indicator.

12. A method of grinding and pulverizing a material in a hammer mill, comprising the steps of:

providing a plurality of hammers each comprising a head for impacting material within the hammer mill, two parallel legs extending from the bottom of each head, and a metallic insert attached to a portion of an impact surface of each head, said metallic insert having a substantially trapezoidal cross section in which the top and bottom are approximately parallel, the front edge and bottom edge form an acute angle of approximately 75 degrees or more, and the rear edge and bottom edge form an angle greater than 105 degrees, so that the top surface initially has more surface area than the bottom surface;

pivotally attaching the two parallel legs of said hammers to the rotor of the hammer mill;

feeding material to be ground and pulverized into the hammer mill; and rotating the rotor to grind and pulverize the material.

13. A hammer for use in a hammer mill, comprising:

a head for impacting material within the hammer mill;

two parallel legs extending from the bottom of the head for being attached to a rotor of the hammer mill; and a metallic insert attached to a portion of an impact surface of the head, the metallic insert having a front surface, a top surface intersecting the front surface, a bottom surface intersecting the front surface and being substantially parallel to the top surface, and a rear surface intersecting the top surface, wherein the front surface and the bottom surface form an acute angle of approximately 75 degrees or more, and the rear surface and the bottom surface form an angle greater than 105 degrees, so that the top surface initially has more surface area than the bottom surface.

14. A hammer according to claim 13, wherein another surface joins the bottom surface and the rear surface.

15. A hammer for use in a hammer mill, comprising:

a head for impacting material within the hammer mill;

two parallel legs extending from the bottom of the head for being attached to a rotor of the hammer mill; and a metallic insert attached to a portion of an impact surface of the head, the metallic insert having a front surface, a top surface intersecting the front surface, a bottom surface intersecting the front surface and being substantially parallel to the top surface, and a rear surface intersecting the top surface, wherein the front surface and the bottom surface form an acute angle of approximately 75 degrees or more, and the top surface initially has more surface area than the bottom surface.

16. A method of grinding and pulverizing a material in a hammer mill, comprising the steps of:

providing a plurality of hammers each comprising a head for impacting material within the hammer mill, two parallel legs extending from the bottom of each head, and a metallic insert attached to a portion of an impact surface of each head, said metallic insert having a front surface, a top surface intersecting the front surface, a bottom surface intersecting the front surface and being substantially parallel to the top surface, and a rear surface intersecting the top surface and forming an acute angle of approximately 75 degrees or more, so that the top surface initially has more surface area than the bottom surface;

pivotally attaching the two parallel legs of said hammers to the rotor of the hammer mill;

feeding material to be ground and pulverized into the hammer mill; and rotating the rotor to grind and pulverize the material.

* * * * *